US007916098B2

(12) United States Patent
Choi et al.

(10) Patent No.: US 7,916,098 B2
(45) Date of Patent: Mar. 29, 2011

(54) PLASMA DISPLAY APPARATUS AND METHOD OF DRIVING THE SAME

(75) Inventors: Jeong Pil Choi, Suwon-si (KR); Kyu Choon Cho, Yongin-si (KR); Woo Chang Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 920 days.

(21) Appl. No.: 11/781,071

(22) Filed: Jul. 20, 2007

(65) Prior Publication Data

US 2008/0018565 A1 Jan. 24, 2008

(30) Foreign Application Priority Data

Jul. 20, 2006 (KR) ..... 10-2006-0068233

(51) Int. Cl.
*G09G 3/28* (2006.01)

(52) U.S. Cl. ..... 345/60; 327/131; 327/134; 327/170; 315/169.4

(58) Field of Classification Search ..... 345/60, 345/63; 315/169.4; 327/131, 134, 170
See application file for complete search history.

(56) References Cited

U.S. PATENT DOCUMENTS

2004/0085262 A1* 5/2004 Lee ..... 345/41
2005/0078058 A1* 4/2005 Loh ..... 345/60
2005/0116895 A1* 6/2005 Lee et al. ..... 345/60
2005/0259041 A1* 11/2005 Moon ..... 345/60

FOREIGN PATENT DOCUMENTS

KR 2001-0085292 A 9/2001
KR 10-2004-0009877 A 1/2004

* cited by examiner

*Primary Examiner* — Alexander Eisen
*Assistant Examiner* — Priyank Shah
(74) *Attorney, Agent, or Firm* — Birch, Stewart, Kolasch & Birch, LLP

(57) ABSTRACT

A plasma display apparatus and a method of driving the same are disclosed. The plasma display apparatus includes a plasma display panel including a scan electrode, and a scan driver that supplies a setup pulse to the scan electrode. The setup pulse gradually rises to a first voltage level with a first slope, rises from the first voltage level to a second voltage level with a second slope smaller than the first slope, and rises from the second voltage level to a third voltage level with a third slope different from the second slope.

9 Claims, 8 Drawing Sheets

PLASMA DISPLAY APPARATUS AND METHOD OF DRIVING THE SAME

This application claims the benefit of Korean Patent Application No. 10-2006-0068233 filed in Korea on Jul. 20, 2006, which is hereby incorporated by reference.

BACKGROUND

1. Field

This document relates to a plasma display apparatus and a method of driving the same.

2. Description of the Related Art

A plasma display apparatus includes a plasma display panel displaying an image, and drivers for driving the plasma display panel.

The plasma display panel has the structure in which barrier ribs formed between a front panel and a rear panel form unit discharge cell or discharge cells. Each discharge cell is filled with an inert gas containing a main discharge gas such as neon (Ne), helium (He) or a mixture of Ne and He, and a small amount of xenon (Xe).

When the plasma display panel is discharged by the application of a high frequency voltage to the unit discharge cell, the inert gas generates vacuum ultraviolet rays, which thereby cause phosphors formed between the barrier ribs to emit light, thus displaying an image.

The plasma display panel includes a plurality of electrodes, and the drivers for supplying driving voltages to the plurality of electrodes are connected to the plurality of electrodes.

Each driver supplies driving pulses to the plurality of electrodes during a reset period, an address period, and a sustain period, and thus the plasma display panel displays an image. It is important to accurately generate discharges and to optimize the driving conditions when the driving pulses are supplied to the electrodes, respectively.

SUMMARY

In one aspect, a plasma display apparatus comprises a plasma display panel including a scan electrode, and a scan driver that supplies a setup pulse to the scan electrode, the setup pulse gradually rising to a first voltage level with a first slope, rising from the first voltage level to a second voltage level with a second slope smaller than the first slope, and rising from the second voltage level to a third voltage level with a third slope different from the second slope.

In another aspect, a plasma display apparatus comprises a plasma display panel including a scan electrode, and a scan driver that supplies a set-down pulse to the scan electrode, the set-down pulse gradually falling to a fourth voltage level with a fourth slope, falling from the fourth voltage level to a fifth voltage level with a fifth slope smaller than the fourth slope, and falling from the fifth voltage level to a sixth voltage level with a sixth slope different from the fifth slope.

In still another aspect, a method of driving a plasma display apparatus including a scan electrode, the method comprises gradually raising a voltage level of the scan electrode to a first voltage level with a first slope, raising the voltage level of the scan electrode from the first voltage level to a second voltage level with a second slope smaller than the first slope, and raising the voltage level of the scan electrode from the second voltage level to a third voltage level with a third slope different from the second slope.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings.

DETAILED DESCRIPTION OF EMBODIMENTS

Figure 1:
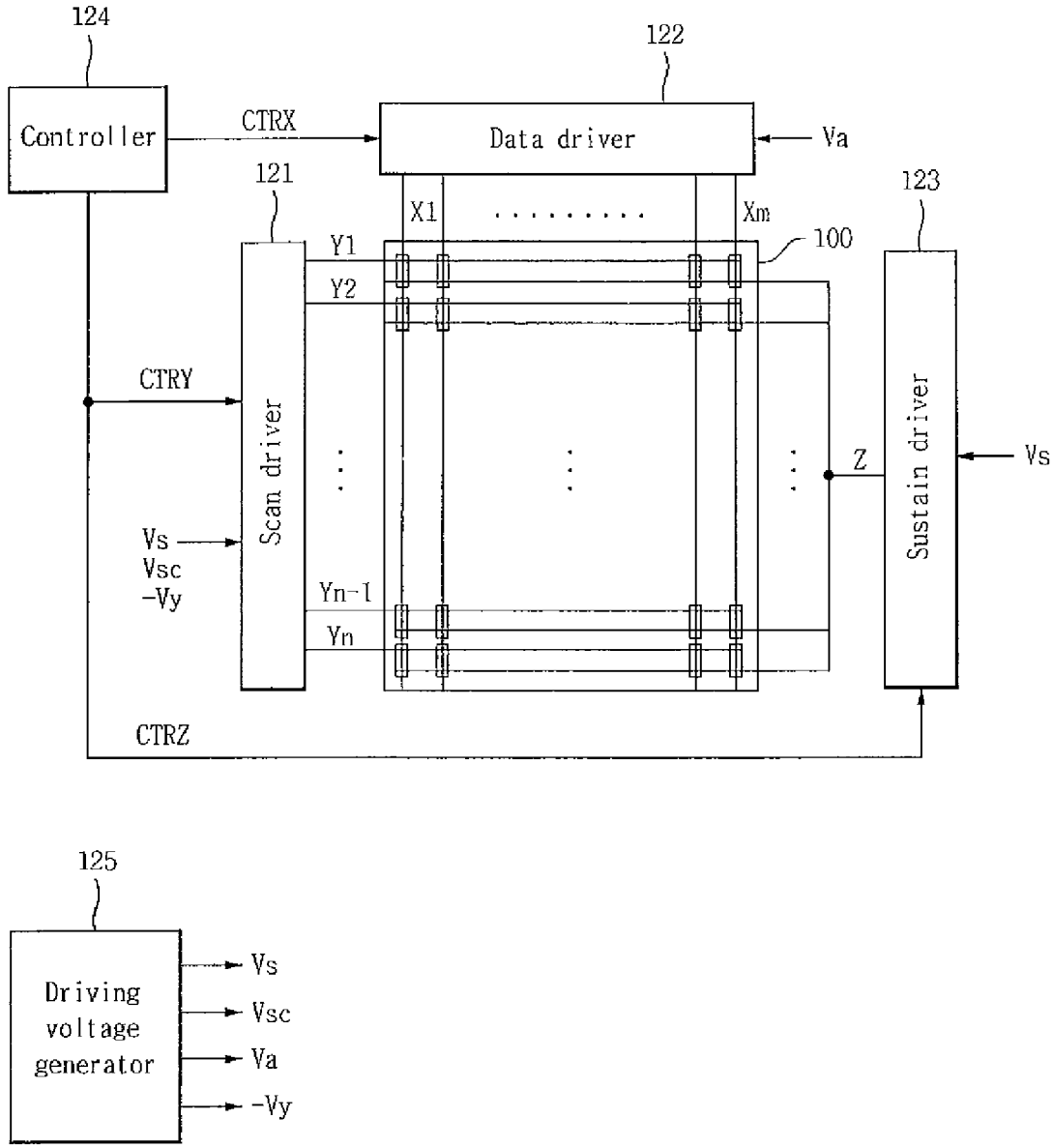
FIG. 1 illustrates a plasma display apparatus according to an exemplary embodiment.

A plasma display apparatus comprises a plasma display panel including a scan electrode, and a scan driver that supplies a setup pulse to the scan electrode, the setup pulse gradually rising to a first voltage level with a first slope, rising from the first voltage level to a second voltage level with a second slope smaller than the first slope, and rising from the second voltage level to a third voltage level with a third slope different from the second slope.

The scan driver may include a voltage unit supplying a sustain voltage to the scan electrode, a first voltage supply unit supplying the first voltage level to the scan electrode, and a setup slope controller that receives the first voltage level and the sustain voltage and supplies the setup pulse having the first, second, and third slopes to the scan electrode.

The setup slope controller may include first and second switches connected in parallel to each other, a first variable resistor connected to the first switch, a second variable resistor connected to the second switch, and a capacitor whose both terminals are connected to the first voltage supply unit and the voltage unit, respectively, wherein a magnitude of the first variable resistor may be different from a magnitude of the second variable resistor.

The first and second switches may be turned on, and thus, the first slope may be formed. The first switch may remain in a turn-on state and the second switch may be turned off, and thus, the second slope may be formed. The first switch may be turned off and the second switch may be turned on, and thus, the third slope may be formed.

The setup slope controller may include a first switch connected to the voltage unit, a first variable resistor connected to the first switch, a second switch receiving the first voltage level, a second variable resistor connected to the second switch, and a capacitor whose both terminals are connected to one terminal of the second switch and the voltage unit, respectively, wherein a magnitude of the first variable resistor may be different from a magnitude of the second variable resistor.

The first and second switches may be turned on, and thus, the first slope may be formed. The first switch may remain in a turn-on state and the second switch may be turned off, and thus, the second slope may be formed. The first switch may be turned off and the second switch may be turned on, and thus, the third slope may be formed.

The scan driver may supply a set-down pulse having a plurality of slopes to the scan electrode after the supply of the setup pulse.

A plasma display apparatus comprises a plasma display panel including a scan electrode, and a scan driver that supplies a set-down pulse to the scan electrode, the set-down pulse gradually falling to a fourth voltage level with a fourth slope, falling from the fourth voltage level to a fifth voltage level with a fifth slope smaller than the fourth slope, and falling from the fifth voltage level to a sixth voltage level with a sixth slope different from the fifth slope.

The scan driver may include a second voltage supply unit supplying a scan voltage to the scan electrode, and a set-down slope controller that receives the scan voltage from the second voltage supply unit and supplies the set-down pulse having the fourth, fifth, and sixth slopes to the scan electrode.

The set-down slope controller may include third and fourth switches connected to the second voltage supply unit, a third variable resistor connected to the third switch, and a fourth variable resistor connected to the fourth switch, wherein a magnitude of the third variable resistor may be different from a magnitude of the fourth variable resistor.

The third and fourth switches may be turned on, and thus, the fourth slope may be formed. The third switch may remain in a turn-on state and the fourth switch may be turned off, and thus, the fifth slope may be formed. The third switch may be turned off and the fourth switch may be turned on, and thus, the sixth slope may be formed.

The set-down slope controller may include a third switch connected to a ground level voltage supply unit, a third variable resistor connected to the third switch, a fourth switch connected to the second voltage supply unit, and a fourth variable resistor connected to the fourth switch, wherein a magnitude of the third variable resistor may be different from a magnitude of the fourth variable resistor.

The third and fourth switches may be turned on, and thus, the fourth slope may be formed. The third switch may remain in a turn-on state and the fourth switch may be turned off, and thus, the fifth slope may be formed. The third switch may be turned off and the fourth switch may be turned on, and thus, the sixth slope may be formed.

The plasma display panel may further include a sustain electrode, the scan driver may supply a set-down pulse that is maintained at the fourth voltage level and then fall with the sixth slope, and a sustain driver may supply a positive bias voltage level to the sustain electrode during a period of time during which the set-down pulse is maintained at the fourth voltage level.

A magnitude of the sixth slope may be smaller than a magnitude of the fourth slope.

The positive bias voltage level may be substantially equal to a sustain voltage level.

The positive bias voltage level may be lower than a sustain voltage level.

A method of driving a plasma display apparatus including a scan electrode, the method comprises gradually raising a voltage level of the scan electrode to a first voltage level with a first slope, raising the voltage level of the scan electrode from the first voltage level to a second voltage level with a second slope smaller than the first slope, and raising the voltage level of the scan electrode from the second voltage level to a third voltage level with a third slope different from the second slope.

The method may further comprise gradually lowering the voltage level of the scan electrode to a fourth voltage level with a fourth slope, lowering the voltage level of the scan electrode from the fourth voltage level to a fifth voltage level with a fifth slope smaller than the fourth slope, and lowering the voltage level of the scan electrode from the fifth voltage level to a sixth voltage level with a sixth slope different from the fifth slope.

The plasma display apparatus may further include a sustain electrode, the voltage level of the scan electrode may be maintained at the fourth voltage level and then fall with the sixth slope, and a positive bias voltage level may be supplied to the sustain electrode during a period of time during which the voltage level of the scan electrode is maintained at the fourth voltage level.

Embodiments will be described in a more detailed manner with reference to the drawings.

FIG. 1 illustrates a plasma display apparatus according to an exemplary embodiment. As illustrated in FIG. 1, a plasma display apparatus according to an exemplary embodiment includes a plasma display panel 100, a scan driver 121, a data driver 122, a sustain driver 123, a controller 124, and a driving voltage generator 125.

The plasma display panel 100 includes a front substrate (not shown) and a rear substrate (not shown), which are coalesced with each other at a given distance therebetween. On the front substrate, scan electrodes Y1 to Yn and sustain electrodes Z are formed. On the rear substrate, data electrodes X1 to Xm are formed to intersect the scan electrodes Y1 to Yn and the sustain electrodes Z.

Under the control of the controller 124, the scan driver 121 supplies a reset pulse for initializing a state of wall charges distributed in discharge cells to the scan electrodes Y1 to Yn during a reset period. The reset pulse includes a setup pulse and a set-down pulse. The scan driver 121 optimizes a discharge by controlling slopes of the setup pulse and the set-down pulse.

Under the control of the controller 124, the scan driver 121 sequentially supplies scan pulses each having the lowest voltage level corresponding to a scan voltage −Vy to the scan electrodes Y1 to Yn during an address period. The scan driver 121 supplies a scan reference voltage Vsc to the scan electrodes Y1 to Yn to which the scan pulses are not supplied.

Under the control of the controller 124, the scan driver 121 supplies a sustain pulse to the scan electrodes Y1- to Yn during a sustain period to generate a sustain discharge inside discharge cells selected during the address period.

The data driver 122 supplies data pulses to the data electrodes X1 to Xm during the address period to select discharges cells in which a sustain discharge will be generated.

Under the control of the controller 124, the sustain driver 123 supplies a sustain bias voltage Vz to the sustain electrodes Z during the address period. The sustain driver 123 can control supply timing of the sustain bias voltage Vz. The supply timing of the sustain bias voltage Vz will be described in detail with reference to FIGS. 6*a* and 6*b*.

The sustain driver 123 supplies a sustain pulse to the sustain electrodes Z during the sustain period. The scan driver 121 and the sustain driver 123 alternately supply the sustain pulses.

The controller 124 receives a vertical/horizontal synchronization signal and a clock signal, and generates timing control signals CTRX, CTRY and CTRZ for controlling operation timing and synchronization of each driver 121, 122 and 123 during the reset, address, and sustain periods. The controller 124 supplies the timing control signals CTRX, CTRY and CTRZ to the corresponding drivers 121, 122 and 123.

The driving voltage generator 125 generates a setup voltage for forming the setup pulse, the scan reference voltage Vsc, the scan voltage −Vy, a sustain voltage Vs corresponding to the highest voltage level of the sustain pulse, and a data voltage Va corresponding to the highest voltage level of the data pulse.

Figure 2:
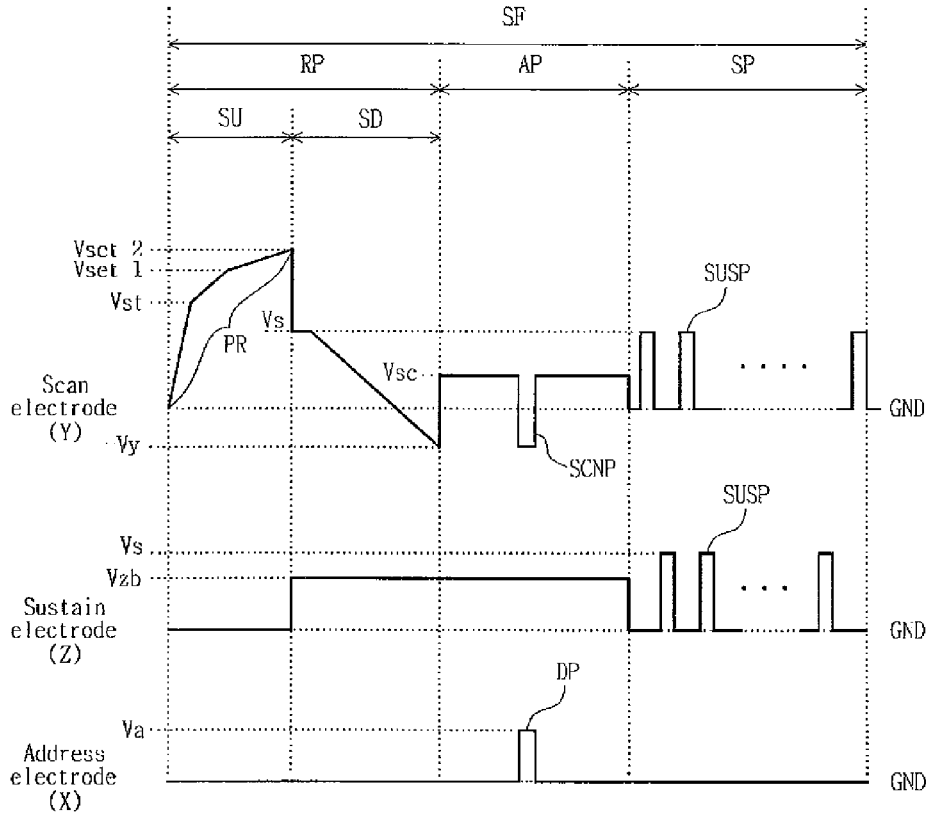
FIG. 2 illustrates a driving waveform of a plasma display apparatus according to an exemplary embodiment.

FIG. 2 illustrates a driving waveform of a plasma display apparatus according to an exemplary embodiment.

The scan driver 121 supplies a setup pulse PR to the scan electrode Y during a setup period SU of a reset period RP to generate a weak discharge within discharge cells of the whole screen. Hence, wall charges are produced within the discharge cells.

The setup pulse PR rises to a first voltage level Vst with a first slope, rises from the first voltage level Vst to a second voltage level Vset1 with a second slope smaller than the first slope, and rises from the second voltage level Vset1 to a third voltage level Vset2 with a third slope different from the second slope.

The scan driver 121 supplies a set-down pulse NR to the scan electrode Y during a set-down period SD of the reset period RP. The set-down pulse NR generates a weak erase discharge within the discharge cells to make the remaining wall charges within the discharge cells uniform.

The set-down pulse NR falls to a fourth voltage level with a fourth slope, falls from the fourth voltage level to a fifth voltage level with a fifth slope smaller than the fourth slope, and falls from the fifth voltage level to a sixth voltage level with a sixth slope different from the fifth slope. The set-down pulse NR will be described in detail with reference to FIGS. 4*a* and 4*b*.

During an address period AP, the scan driver 121 supplies a scan pulse SCNP to the scan electrode Y, and the data driver 122 supplies a data pulse DP to the data electrode X. As the voltage difference between the scan pulse SCNP and the data pulse DP is added to the wall voltage generated during the reset period RP, an address discharge is generated within the discharge cells to which the data pulse DP is supplied.

The sustain driver 123 supplies a positive bias voltage Vzb to the sustain electrode Z during the set-down period SD and the address period AP so that an erroneous discharge does not occur between the sustain electrode Z and the scan electrode Y.

During a sustain period SP, the scan driver 121 and the sustain driver 123 alternately supply a sustain pulse SUSP to the scan electrode Y and the sustain electrode Z to generate a sustain discharge.

Figure 3:
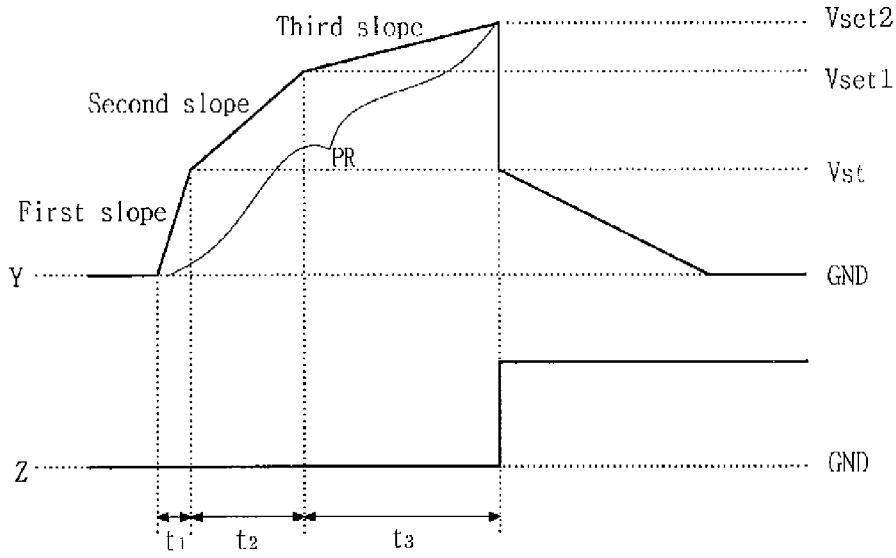
FIG. 3 illustrates a reset pulse of FIG. 2.

FIG. 3 illustrates a reset pulse of FIG. 2. As illustrated in FIG. 3, the scan driver 121 supplies the setup pulse PR having the first, second and third slopes to the scan electrode Y.

With the supply of the setup pulse PR, a voltage level of the scan electrode Y rises to the first voltage level Vst with the first slope, rises from the first voltage level Vst to the second voltage level Vset1 with the second slope smaller than the first slope, and rises from the second voltage level Vset1 to the third voltage level Vset2 with the third slope smaller than the second slope. The first voltage level Vst may be substantially equal to the highest voltage level of the sustain pulse SUSP of FIG. 2.

The setup pulse PR having the first, second and third slopes can optimize the discharge conditions. For example, the setup pulse PR having the first slope gradually changes a voltage level of the scan electrode Y during a period t1, thereby preventing the occurrence of a peaking current and generating an effective discharge.

Further, it is easy to remove wall charges using the setup pulse PR having the first, second and third slopes. Hence, an erroneous discharge can be prevented. The setup pulse PR suitable for various driving conditions can be supplied by controlling the slope of the setup pulse PR.

Figure 4A:
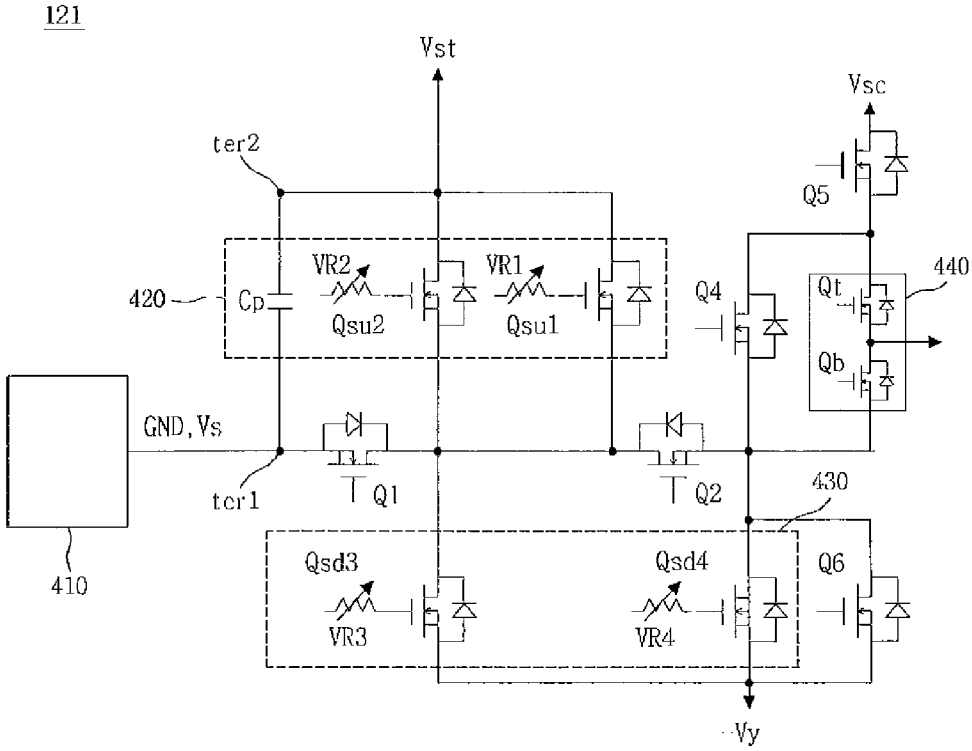
FIG. 4*a* illustrates a scan driver of a plasma display apparatus according to a first exemplary embodiment.
Figure 4B:
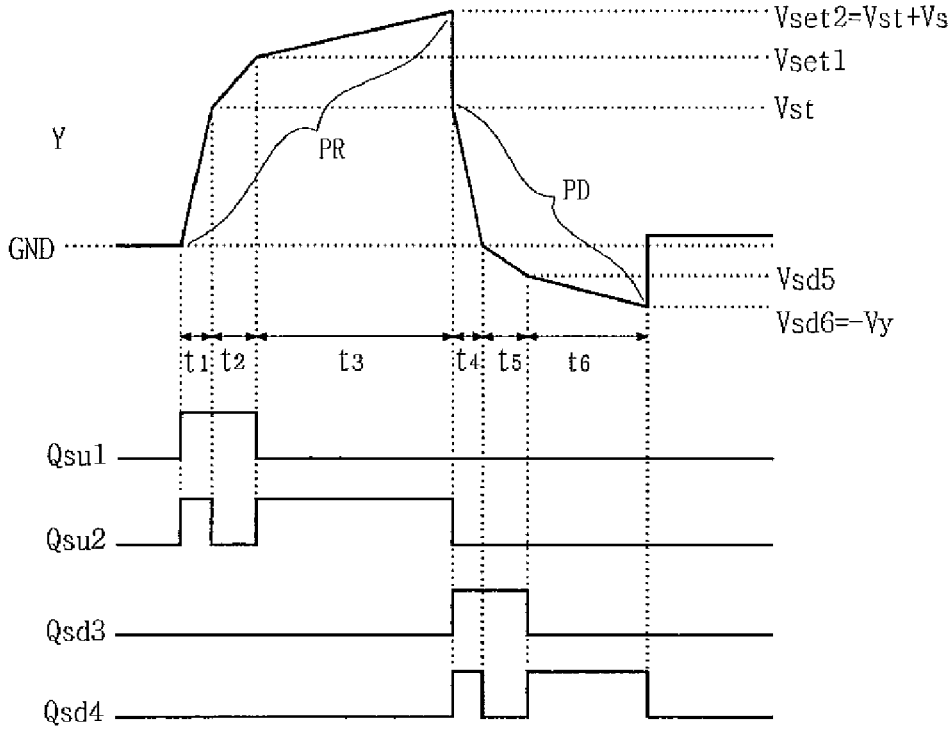
FIG. 4*b* illustrates a driving waveform and switch timing of the scan driver of FIG. 4*a;*

FIG. 4*a* illustrates a scan driver of a plasma display apparatus according to a first exemplary embodiment. FIG. 4*b* illustrates a driving waveform and switch timing of the scan driver of FIG. 4*a*.

The scan driver 121 of FIG. 4*a* includes a voltage unit 410, a first voltage supply unit Vst, a setup slope controller 420, a second voltage supply unit −Vy, a set-down slope controller 430, and a scan driving unit 440.

The voltage unit 410 supplies a ground level voltage GND or a sustain voltage Vs. Although the voltage unit 410 supplies the sustain voltage Vs in the first exemplary embodiment, the voltage unit 410 can supply another voltage level other than the sustain voltage Vs.

The first voltage supply unit Vst supplies the first voltage level.

The setup slope controller 420 includes first and second switches Qsu1 and Qsu2, first and second variable resistors VR1 and VR2, and a capacitor Cp. The setup slope controller 420 receives the first voltage level Vst and the sustain voltage Vs, and supplies the setup pulse PR having the first, second, and third slopes to the scan electrode Y.

In the setup slope controller 420, the first and second switches Qsu1 and Qsu2 are connected in parallel to each other. The first variable resistor VR1 is connected to the first switch Qsu1, and the second variable resistor VR2 is connected to the second switch Qsu2. The capacitor Cp includes one terminal ter1 connected to the voltage unit 410, and the other terminal ter2 connected to a common terminal of the first and second switches Qsu1 and Qsu2.

As illustrated in FIG. 4*b*, during a period t1 of a reset period, the voltage unit 410 supplies a ground level voltage GND, and a switch Q1 is turned off. Further, the first and second switches Qsu1 and Qsu2 of the setup slope controller 420 are turned on, and a switch Q2 and a switch Qb of the scan driving unit 440 are turned on.

As a result, the capacitor Cp connected to the first voltage supply unit Vst and the voltage unit 410 is charged to the first voltage level Vst, and the first voltage level Vst is supplied to the scan electrode Y due to the turned-on first and second switches Qsu1 and Qsu2. Since the first and second switches Qsu1 and Qsu2 operate in an active area, a voltage level of the scan electrode Y gradually rises to the first voltage level Vst with the first slope. A magnitude of the first slope is controlled by the first and second variable resistors VR1 and VR2 connected to the first and second switches Qsu1 and Qsu2.

When the first and second switches Qsu1 and Qsu2 are simultaneously turned on, a line resistance decreases due to an increase in a current path. Therefore, a voltage level of the scan electrode Y rapidly rises to the first voltage level Vst.

During a period t2 of the reset period, the voltage unit 410 supplies the sustain voltage Vs, and the switch Q1 remains in a turn-off state. In the setup slope controller 420, the first switch Qsu1 remains in a turn-on state, and the second switch Qsu2 is turned off. The switch Q2 and the switch Qb of the scan driving unit 440 remain in a turn-on state.

Since the capacitor Cp is charged to the first voltage level Vst during the period t1, the voltage unit 410 supplies the sustain voltage Vs to one terminal ter1 of the capacitor Cp during the period t2 and a voltage of the other terminal ter2 of the capacitor Cp is equal to a sum of the first voltage level Vst and the sustain voltage Vs.

The voltage of the other terminal ter2 of the capacitor Cp is supplied to the scan electrode Y through the first switch Qsu1, the switch Q2, and the switch Qb. Hence, a voltage level of the scan electrode Y gradually rises from the first voltage level Vst to the second voltage level Vset1 with the second slope. A magnitude of the second slope is smaller than a magnitude of the first slope. As above, since the first and second switches Qsu1 and Qsu2 are turned on during the period t1 and only the first switch Qsu1 is turned on during the period t2, the magnitude of the first slope formed during the period t1 of a small line resistance is larger than the magnitude of the second slope.

The second slope is controlled depending on the first variable resistor VR1 connected to the first switch Qsu1.

During a period t3 of the reset period, the voltage unit 410 supplies the sustain voltage Vs, and the switch Q1 remains in a turn-off state. In the setup slope controller 420, the first switch Qsu1 is turned off, and the second switch Qsu2 is turned on. The switch Q2 and the switch Qb of the scan driving unit 440 remain in a turn-on state.

Since a voltage of the other terminal ter2 of the capacitor Cp is equal to a sum of the first voltage level Vst and the sustain voltage Vs, a voltage level of the scan electrode Y gradually rises from the second voltage level Vset1 to the third voltage level Vset2 with the third slope. The third slope is controlled depending on the second variable resistor VR2 connected to the second switch Qsu2.

A magnitude of the first variable resistor VR1 may be different from a magnitude of the second variable resistor VR2. Hence, the magnitudes of the first, second and third slopes can variously change.

Although FIGS. 2 and 3 illustrate the set-down pulse having one slope, a set-down pulse having a plurality of slopes will be described in detail with reference to FIGS. 4*a* and 4*b*.

The second voltage supply unit −Vy supplies a scan voltage.

The set-down slope controller 430 supplies a set-down pulse PD to the scan electrode Y. The set-down pulse PD falls to a fourth voltage level with a fourth slope, falls from the fourth voltage level to a fifth voltage level Vsd5 with a fifth slope smaller than the fourth slope, and falls from the fifth voltage level Vsd5 to a sixth voltage level Vsd6 with a sixth slope different from the fifth slope. The set-down slope controller 430 receives the scan voltage from the second voltage supply unit −Vy, and supplies the set-down pulse PD having the fourth, fifth and sixth slopes to the scan electrode Y.

The set-down slope controller 430 includes a third switch Qsd3, a fourth switch Qsd4, a third variable resistor VR3, and a fourth variable resistor VR4. One terminal of each of the third switch Qsd3 and the fourth switch Qsd4 is connected to the second voltage supply unit −Vy. The third variable resistor VR3 is connected to the third switch Qsd3, and the fourth variable resistor VR4 is connected to the fourth switch Qsd4.

After the supply of the setup pulse PR, as illustrated in FIG. 4*b*, the set-down pulse PD perpendicularly falls from the third voltage level Vset2 to the sustain voltage Vs, and then falls to the fourth voltage level with the fourth slope during a period t4. The fourth voltage level may be equal to a ground level voltage GND.

During the period t4 of a set-down period of the reset period, the third and fourth switches Qsd3 and Qsd4 are turned on, and the switch Qb is turned on. Since the third and fourth switches Qsd3 and Qsd4 operate in an active area, a voltage level of the scan electrode Y falls to the fourth voltage level with the fourth slope. A magnitude of the fourth slope is controlled by the third and fourth variable resistors VR3 and VR4 connected to the third and fourth switches Qsd3 and Qsd4.

During a period t5 of the set-down period, the third switch Qsd3 remains in a turn-on state, the fourth switch Qsd4 is turned off, and the switch Qb is turned on. Hence, a voltage level of the scan electrode Y falls from the fourth voltage level to the fifth voltage level Vsd5 with the fifth slope. A magnitude of the fifth slope is smaller than a magnitude of the fourth slope. This reason is to increase a current path when the third and fourth switches Qsd3 and Qsd4 are turned on during the period t4 and to reduce a current path when only the third switch Qsd3 is turned on during the period t5. The fifth slope can be controlled depending on the third variable resistor VR3 connected to the third switch Qsd3.

During a period t6 of the set-down period, the third switch Qsd3 is turned off, the fourth switch Qsd4 is turned on, and the switch Qb remains a turn-on state. Hence, a voltage level of the scan electrode Y falls from the fifth voltage level Vsd5 to the sixth voltage level Vsd6 with the sixth slope. The sixth slope can be controlled depending on the fourth variable resistor VR4 connected to the fourth switch Qsd4. The sixth voltage level Vsd6 may be equal to the scan voltage −Vy.

Since the set-down pulse PD has a plurality of slopes, the discharge conditions of the plasma display panel can be optimized.

A switch Q5 supplies a scan reference voltage Vsc of FIG. 2 to the scan electrode Y during an address period. A switch Q6 supplies a scan pulse SCNP of FIG. 2 to the scan electrode Y during the address period. The switch Q2 is turned off during the periods t4 to t6.

Since a magnitude of the fourth slope is larger than a magnitude of the fifth slope in the set-down pulse PD, a duration of the set-down period can be reduced. In other words, since the set-down pulse PD generates a weak discharge in the second half of the set-down period, a duration of the set-down period can be reduced when the magnitude of the fourth slope is larger than the magnitude of the fifth slope.

Further, if the slope of the set-down pulse PD supplied to the scan electrode in the first half of the set-down period is large, an erroneous discharge may be easily generated. Therefore, an erroneous discharge can be prevented by controlling a supply time point of a positive bias voltage level supplied to the sustain electrode. For instance, an erroneous discharge caused by a voltage difference between the scan electrode and the sustain electrode can be prevented by supplying a positive bias voltage level at any falling time point of the set-down pulse, for instance, during a period of time during which the set-down pulse is maintained at the first voltage level Vst.

Figure 5A:
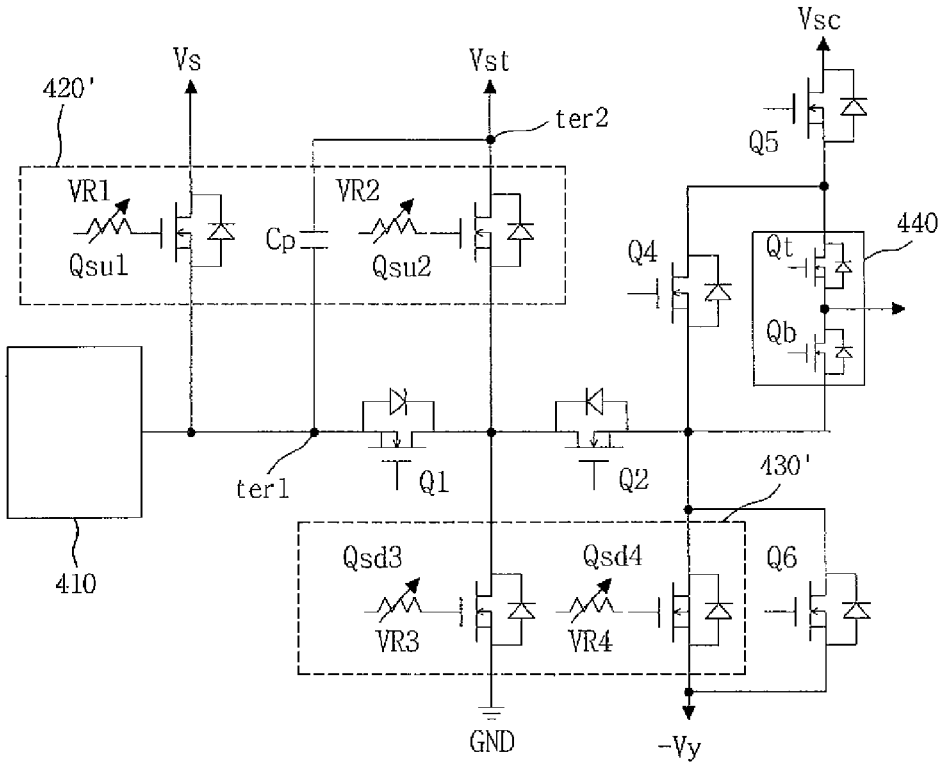
FIG. 5*a* illustrates a scan driver of a plasma display apparatus according to a second exemplary embodiment.
Figure 5B:
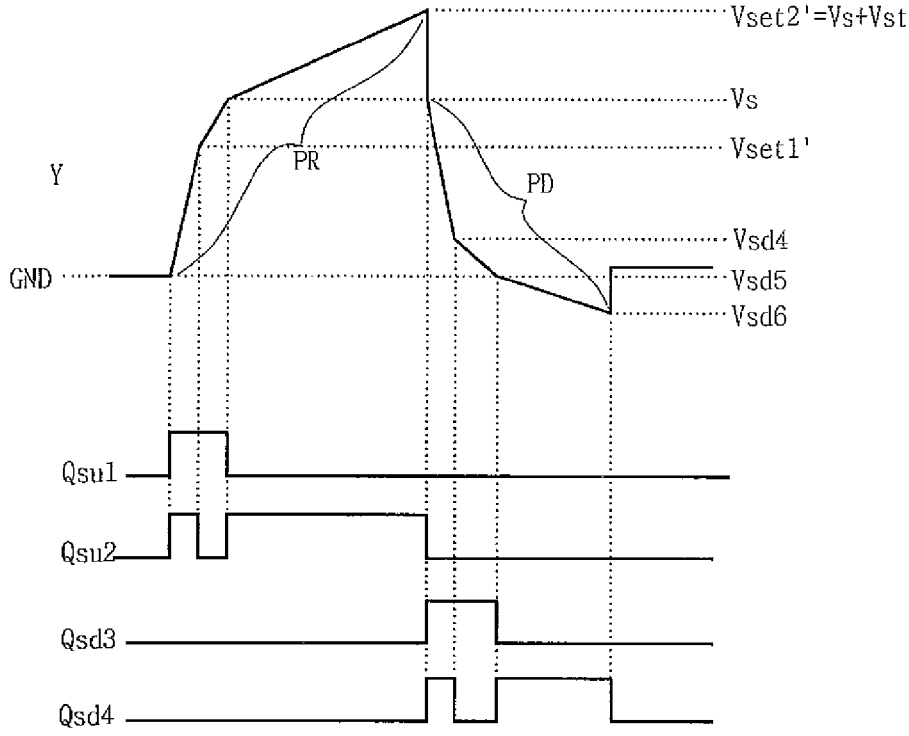
FIG. 5*b* illustrates a driving waveform and switch timing of the scan driver of FIG. 5*a;*

FIG. 5*a* illustrates a scan driver of a plasma display apparatus according to a second exemplary embodiment. FIG. 5*b* illustrates a driving waveform and switch timing of the scan driver of FIG. 5*a*.

A setup slope controller 420' includes a first switch Qsu1 connected to a voltage unit 410, a first variable resistor VR1 connected to the first switch Qsu1, a second switch Qsu2 receiving a fist voltage level, a second variable resistor VR2 connected to the second switch Qsu2, and a capacitor Cp whose both terminals are connected to one terminal of the second switch Qsu2 and the voltage unit 410, respectively.

As illustrated in FIG. 5*b*, during a period t1 of a reset period, the voltage unit 410 enters into a floating state, and switches Q1 and Q2 are turned on. Further, the first and second switches Qsu1 and Qsu2 of the setup slope controller 420' are turned on, and the switch Q2 and a switch Qb of a scan driving unit 440 are turned on.

A first voltage level Vset1' is supplied to the scan electrode Y due to the turned-on first and second switches Qsu1 and Qsu2. Since the first and second switches Qsu1 and Qsu2 operate in an active area, a voltage level of the scan electrode Y gradually rises to the first voltage level Vset1' with a first slope. A magnitude of the first slope is controlled by the first and second variable resistors VR1 and VR2 connected to the first and second switches Qsu1 and Qsu2.

When the first and second switches Qsu1 and Qsu2 are simultaneously turned on, a voltage level of the scan electrode Y rapidly rises to the first voltage level Vset1' due to an increase in a current path.

During a period t2, the voltage unit 410 remains in a floating state, and the switches Q1, Q2 and Qb remain in a turn-on state. Further, the first switch Qsu1 remains in a turn-on state, and the second switch Qsu2 is turned off. Hence, a voltage level of the scan electrode Y rises from the first voltage level Vset1' to a second voltage level with a second slope. The second voltage level is equal to a sustain voltage Vs. A magnitude of the second slope is smaller than a magnitude of the first slope due to a reduction in a current path during the period t2.

During a period t3, the voltage unit 410 supplies the sustain voltage Vs, and the switches Q1, Q2 and Qb remain in a turn-on state. Further, the first switch Qsu1 is turned off, and the second switch Qsu2 is turned on. Hence, one terminal ter1 of the capacitor Cp is charged to the sustain voltage Vs, and a voltage of the other terminal ter2 of the capacitor Cp is equal to a sum of a first voltage level Vst supplied by a first voltage supply unit Vst and the sustain voltage Vs. Accordingly, a voltage level of the scan electrode Y rises from the second voltage level Vs to a third voltage level (Vst+Vs) with a third slope.

When a magnitude of the second variable resistor VR2 is different from a magnitude of a third variable resistor VR3, the second slope may be different from the third slope.

A set-down slope controller 430' includes a third switch Qsd3, a fourth switch Qsd4, a third variable resistor VR3, and a fourth variable resistor VR4. One terminal of the third switch Qsd3 is connected to a ground level voltage supply unit GND, and one terminal of the fourth switch Qsd4 is connected to the second voltage supply unit −Vy. The third variable resistor VR3 is connected to the third switch Qsd3, and the fourth variable resistor VR4 is connected to the fourth switch Qsd4.

During a period t4, the third and fourth switches Qsd3 and Qsd4 are turned on, and the switches Q2 and Qb are turned on. Hence, a voltage level of the scan electrode Y gradually falls to a fourth voltage level Vsd4 with a fourth slope.

During a period t5, the third switch Qsd3 remains in a turn-on state, the fourth switch Qsd4 is turned off, and the switches Q2 and Qb remain in a turn-on state. Hence, a voltage level of the scan electrode Y gradually falls from the fourth voltage level Vsd4 to a fifth voltage level Vsd5 with a fifth slope. The fifth voltage level Vsd5 is substantially equal to a ground level voltage GND. A magnitude of the fifth slope is smaller than a magnitude of the fourth slope due to a reduction in a current path during the period t5.

During a period t6, the third switch Qsd3 is turned off, the fourth switch Qsd4 is turned on, the switch Q2 is turned off, and the switch Qb remains in a turn-on state. Hence, a voltage level of the scan electrode Y gradually falls from the fifth voltage level Vsd5 to a sixth voltage level Vsd6 with a sixth slope. The sixth voltage level Vsd6 is substantially equal to the scan voltage −Vy. When a magnitude of the third variable resistor VR3 is different from a magnitude of a fourth variable resistor VR4, the fifth slope may be different from the sixth slope.

Figure 6A:
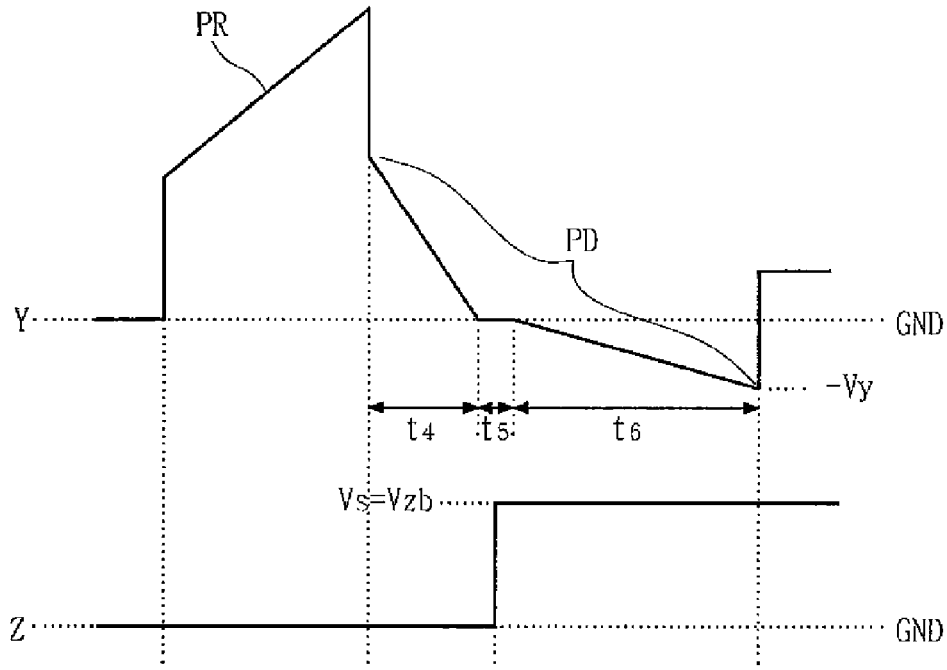
FIG. 6*a* illustrates another driving waveform of the scan driver of FIG. 5*a*.

FIG. 6*a* illustrates another driving waveform of the scan driver of FIG. 5*a*.

During a period t4, the third switch Qsd3 and the fourth switch Qsd4 are simultaneously turned on. When a voltage level of the scan electrode Y is equal to a ground level voltage GND, the third switch Qsd3 remains in a turn-on state and the fourth switch Qsd4 is turned off during a period t5. During a period t6, the third switch Qsd3 is turned off, and the fourth switch Qsd4 is turned on. A magnitude of a sixth slope of the period t6 is smaller than a magnitude of a fourth slope of the period t4.

The sustain driver 123 of FIG. 1 supplies a positive bias voltage Vzb to the sustain electrode Z during the period t5. The positive bias voltage Vzb is substantially equal to the sustain voltage Vs.

If the magnitude of the fourth slope is larger than a magnitude of a fifth slope in a set-down pulse PD, an erroneous discharge may be easily generated. Therefore, an erroneous discharge can be prevented by controlling a supply time point of the positive bias voltage Vzb supplied to the sustain electrode Z. For instance, when a voltage level of the scan electrode Y is maintained at a ground level voltage GND during the period t5, an erroneous discharge caused by a voltage difference between the scan electrode and the sustain electrode can be prevented due to the supply of the positive bias voltage Vzb.

Figure 6B:
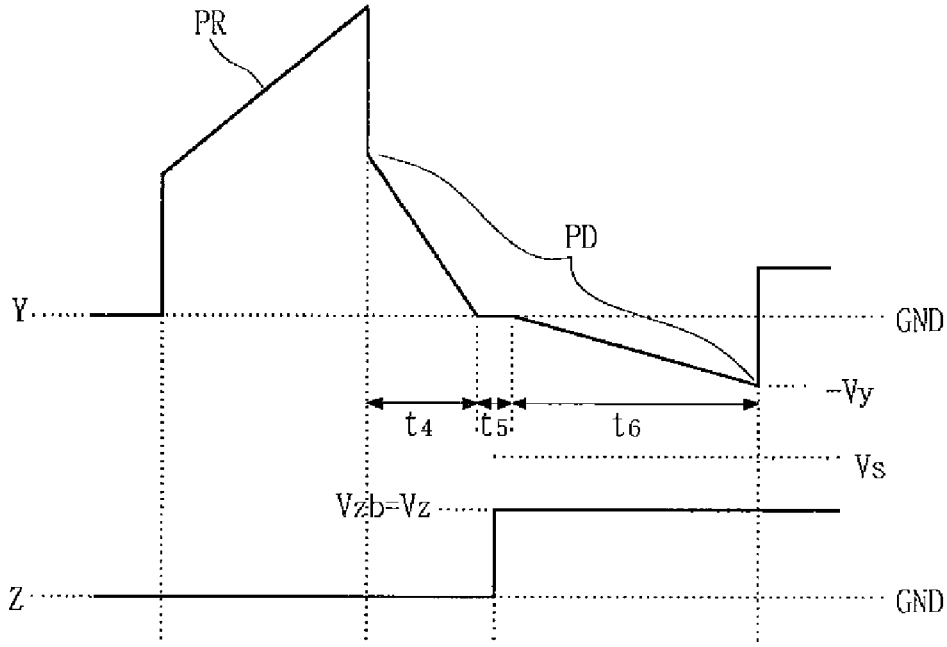
FIG. 6*b* illustrates another driving waveform of the scan driver of FIG. 5*a*.

FIG. 6*b* illustrates another driving waveform of the scan driver of FIG. 5*a*. As illustrated in FIG. 6*b*, the sustain driver 123 of FIG. 1 can supply a positive bias voltage Vzb having a predetermined voltage level Vz to the sustain electrode Z during a period t5. The predetermined voltage level Vz may be lower than the sustain voltage Vs.

The sustain driver 123 controls the positive bias voltage Vzb to optimize the discharge conditions.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display apparatus comprising:

a plasma display panel including a scan electrode; and a scan driver that supplies a setup pulse to the scan electrode, the setup pulse gradually rising to a first voltage level with a first slope, rising from the first voltage level to a second voltage level with a second slope smaller than the first slope, and rising from the second voltage level to a third voltage level with a third slope different from the second slope, wherein the scan driver includes a voltage unit supplying a sustain voltage to the scan electrode, a first voltage supply unit supplying the first voltage level to the scan electrode, and a setup slope controller that receives the first voltage level and the sustain voltage and supplies the setup pulse having the first, second, and third slopes to the scan electrode, wherein the setup slope controller includes first and second switches connected in parallel to each other, a first variable resistor connected to the first switch, a second variable resistor connected to the second switch, and a capacitor whose both terminals are connected to the first voltage supply unit and the voltage unit, respectively, wherein a magnitude of the first variable resistor is different from a magnitude of the second variable resistor, and wherein the first and second switches are turned on, and thus, the first slope is formed, the first switch remains in a turn-on state and the second switch is turned off, and thus, the second slope is formed, and the first switch is turned off and the second switch is turned on, and thus, the third slope is formed.

2. The plasma display apparatus of claim 1, wherein the scan driver supplies a set-down pulse having a plurality of slopes to the scan electrode after the supply of the setup pulse.

3. A plasma display apparatus comprising:

a plasma display panel including a scan electrode; and a scan driver that supplies a set-down pulse to the scan electrode, the set-down pulse gradually falling to a fourth voltage level with a fourth slope, falling from the fourth voltage level to a fifth voltage level with a fifth slope smaller than the fourth slope, and falling from the fifth voltage level to a sixth voltage level with a sixth slope different from the fifth slope, wherein the scan driver includes a second voltage supply unit supplying a scan voltage to the scan electrode, and a set-down slope controller that receives the scan voltage from the second voltage supply unit and supplies the set-down pulse having the fourth, fifth, and sixth slopes to the scan electrode, wherein the set-down slope controller includes third and fourth switches connected to the second voltage supply unit, a third variable resistor connected to the third switch, and a fourth variable resistor connected to the fourth switch, wherein a magnitude of the third variable resistor is different from a magnitude of the fourth variable resistor, and wherein the third and fourth switches are turned on, and thus, the fourth slope is formed, the third switch remains in a turn-on state and the fourth switch is turned off, and thus, the fifth slope is formed, and the third switch is turned off and the fourth switch is turned on, and thus, the sixth slope is formed.

4. The plasma display apparatus of claim 3, wherein the plasma display panel further includes a sustain electrode, the scan driver supplies a set-down pulse that is maintained at the fourth voltage level and then falls with the sixth slope, and a sustain driver supplies a positive bias voltage level to the sustain electrode during a period of time during which the set-down pulse is maintained at the fourth voltage level.

5. The plasma display apparatus of claim 4, wherein a magnitude of the sixth slope is smaller than a magnitude of the fourth slope.

6. The plasma display apparatus of claim 4, wherein the positive bias voltage level is substantially equal to a sustain voltage level.

7. The plasma display apparatus of claim 4, wherein the positive bias voltage level is lower than a sustain voltage level.

8. A plasma display apparatus comprising:

a plasma display panel including a scan electrode; and a scan driver that supplies a setup pulse to the scan electrode, the setup pulse gradually rising to a first voltage level with a first slope, rising from the first voltage level to a second voltage level with a second slope smaller than the first slope, and rising from the second voltage level to a third voltage level with a third slope different from the second slope, wherein the scan driver includes a voltage unit supplying a sustain voltage to the scan electrode, a first voltage supply unit supplying the first voltage level to the scan electrode, and a setup slope controller that receives the first voltage level and the sustain voltage and supplies the setup pulse having the first, second, and third slopes to the scan electrode, wherein the setup slope controller includes a first switch connected to the voltage unit, a first variable resistor connected to the first switch, a second switch receiving the first voltage level, a second variable resistor connected to the second switch, and a capacitor whose both terminals are connected to one terminal of the second switch and the voltage unit, respectively, wherein a magnitude of the first variable resistor is different from a magnitude of the second variable resistor, and wherein the first and second switches are turned on, and thus, the first slope is formed, the first switch remains in a turn-on state and the second switch is turned off, and thus, the second slope is formed, and the first switch is turned off and the second switch is turned on, and thus, the third slope is formed.

9. A plasma display apparatus comprising:

a plasma display panel including a scan electrode; and a scan driver that supplies a set-down pulse to the scan electrode, the set-down pulse gradually falling to a fourth voltage level with a fourth slope, falling from the fourth voltage level to a fifth voltage level with a fifth slope smaller than the fourth slope, and falling from the fifth voltage level to a sixth voltage level with a sixth slope different from the fifth slope, wherein the scan driver includes a second voltage supply unit supplying a scan voltage to the scan electrode, and a set-down slope controller that receives the scan voltage from the second voltage supply unit and supplies the set-down pulse having the fourth, fifth, and sixth slopes to the scan electrode, wherein the set-down slope controller includes a third switch connected to a ground level voltage supply unit, a third variable resistor connected to the third switch, a fourth switch connected to the second voltage supply unit, and a fourth variable resistor connected to the fourth switch, wherein a magnitude of the third variable resistor is different from a magnitude of the fourth variable resistor, and wherein the third and fourth switches are turned on, and thus, the fourth slope is formed, the third switch remains in a turn-on state and the fourth switch is turned off, and thus, the fifth slope is formed, and the third switch is turned off and the fourth switch is turned on, and thus, the sixth slope is formed.

* * * * *